US005868602A

United States Patent [19]

Pallman

[11] Patent Number: 5,868,602

[45] Date of Patent: Feb. 9, 1999

[54] METHOD AND DEVICE FOR RESHARPENING KNIVES USED IN SIZE-REDUCTION MACHINES, ESPECIALLY IN WOOD FLAKING MACHINES

[76] Inventor: Wilhelm Pallman, Kreuzberg Str. 35, Zweibruecken, D-66482, Germany

[21] Appl. No.: 898,354

[22] Filed: Jul. 22, 1997

[30] Foreign Application Priority Data

Jul. 23, 1996 [DE] Germany ..... 196 29 668.4

[51] Int. Cl.[6] ..... B24B 1/00

[52] U.S. Cl. ..... 451/10; 451/45; 451/224; 451/193; 451/214; 451/149

[58] Field of Search ..... 451/45, 9, 10, 451/11, 229, 234, 241, 235, 193, 187, 214, 224, 122, 128, 124, 372, 403, 149

[56] References Cited

U.S. PATENT DOCUMENTS 5,525,094 6/1996 Pallman ..... 451/45

*Primary Examiner*—Eileen P. Morgan
*Attorney, Agent, or Firm*—Foley & Lardner

[57] ABSTRACT

The invention is based on the method for the resharpening of knives used in size-reduction machines described in U.S. Pat. No. 5,525,094 in which the knives remain installed in a rotatable knife carrier. With this invention the process has been further developed in so far as the cutting edges S are ground one after another respectively at one stop position of the knife carrier 8 in which the radial ray $\overline{MS}$ of the cutting circle with the direction $\overline{mS}$ of the grinding feed v at the knife cutting edges S encloses the clearance angle $\phi$. So the invention offers the possibility to choose for the cutting edges any clearance angle matching the properties of the material to be flaked.

11 Claims, 5 Drawing Sheets

METHOD AND DEVICE FOR RESHARPENING KNIVES USED IN SIZE-REDUCTION MACHINES, ESPECIALLY IN WOOD FLAKING MACHINES

BACKGROUND OF THE INVENTION

U.S. Pat. No. 5,525,094 describes a method and device allowing the resharpening by grinding of the cutting edges of knives fastened in cylindrical, rotatable knife carriers of size-reduction machines by means of releasable clamps without needing to demount the knives from their carriers. In this already known resharpening method, the grinding of the cutting edges occurs while the knife carrier is continuously rotating slowly and the radial grinding feed of the cutting edges is programmed according to the state of wear. For knife rims with cutting edges directed to the interior, as they are, for example, used to flake wood, this patent also already discloses a special sharpening device comprising a rotational disc for the knife rim placed on a machine frame as well as a cross-wise translatory moveable grinding unit and an adjustment device feeding evenly the knives toward the interior, over the cylindrical inner wall of the knife rim.

These proposals already offer the considerable technical and economical progress since the cumbersome, time-consuming and potentially injurious handling of the heavy knife kits is no longer necessary. Considering the frequent knife changes due to the rapid wear of the cutting edges, they allow a considerable reduction of the maintenance work for the concerned personnel and consequently also the down-time of the size-reduction machines. Furthermore the present state of wear in the areas adjacent to the cutting edges are recorded and taken into account when programming the grinding feed so that the protrusion of the cutting edge over the relevant inner surface of the knife rim which is decisive for the working process and the required final quality remains constant even after several resharpenings.

Yet the disadvantage of this sharpening method is, that, as a consequence of the constant rotation of the knife carrier during the grinding process, the face of the knife gets a contour which conforms with the cutting circle resulting inevitably in a clearance angle of zero. It must be admitted that a clearance angle of zero has proven to be effective when grinding a lot of products, but there are products having properties, e.g., density and coefficient of friction, which require a specially adapted clearance angle. That is the case for example for some wood species having a high density and/or a high coefficient of friction due to their high content of resin. Here a clearance angle of zero will cause too much generation of heat during the flaking process.

SUMMARY OF THE INVENTION

So, it is an object of the invention to allow the resharpening of knives in their installed state while creating a clearance angle matching the properties of the product to be processed without renouncing to the other advantages of the sharpening method already disclosed in U.S. Pat. No. 5,525,094.

This task is solved by the process steps already described in U.S. Pat. No. 5,525,094 for resharpening of knives in their installed state by the method described in claim 1. Due to the fact that the single knife cutting edges are ground while the knife carrier is fixed in a determined position, the face of the knives gets a contour matching the radius of the grinding means so that the tangents applied at the face of the knives and at the cutting circle result in the corresponding clearance angle.

If the sharpening procedure is designed in a way that the advancing of the knives and the grinding of their cutting edges are done simultaneously, the resharpening takes much less time.

If, as it is already known from U.S. Pat. No. 5,525,094, the condition of wear of the knife carrier adjacent to the cutting edges is recorded and taken into account in the programming of the grinding feed, the optimum knife protrusion for the respective material to be processed is achieved under consideration of the present state of wear of the carrier.

If the grinding unit itself serves as a stop for the worn out cutting edges while advancing the knives, this means a considerable simplification of the sharpening process, but after several sharpening procedures, one must put up with a gradually increasing protrusion of the cutting edge over the inner wall of the knife rim.

In a further embodiment of the invention the knife carrier can be taken out from the size-reduction machine and handled in a special sharpening device.

This sharpening device differs from the device described in U.S. Pat. No. 5,525,094 essentially by the fact that the advance track of the grinding support is inclined to the radial ray of the cutting circle tangential to the respective knife edge by the desired clearance angle.

Further details of the specific sharpening device are largely based on the features already known from U.S. Pat. No. 5,525,094.

A special feature must particularly be mentioned since it is an object of the invention. The inclination angle of the advance track of the grinding unit support is adjustable so that the clearance angle can be adapted to the properties of the products to be reduced in size.

BRIEF DESCRIPTION OF THE DRAWINGS

The accompanying drawings show an example of an embodiment of the invention especially suitable for knife rims used to flake wood chips. This example will be detailed in the following. The drawings show.

DETAILED DESCRIPTION OF THE PREFERRED EMBODIMENTS OF THE INVENTION

Figure 1:
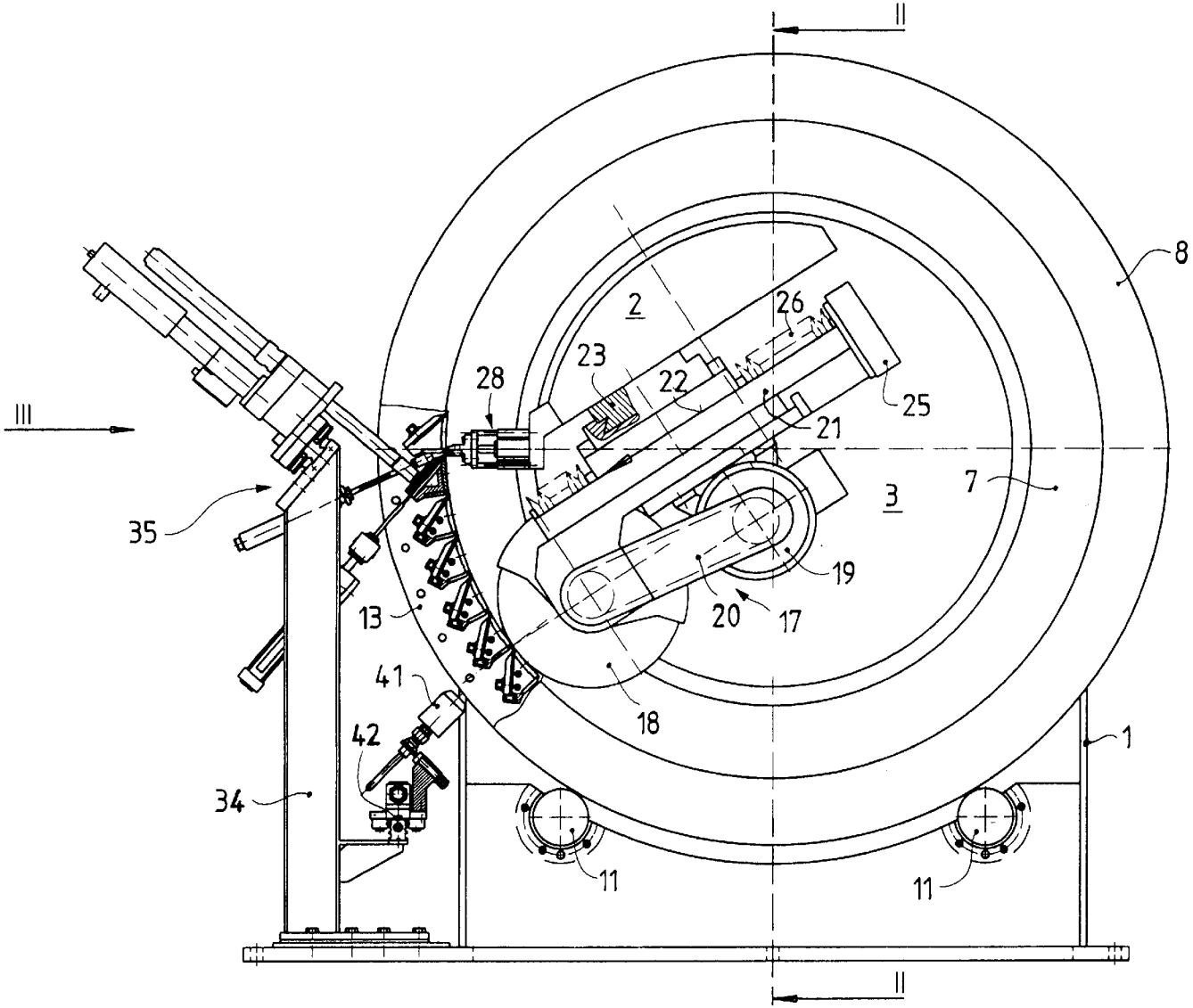
FIG. 1 a front view of a resharpening device according to the invention.
Figure 2:
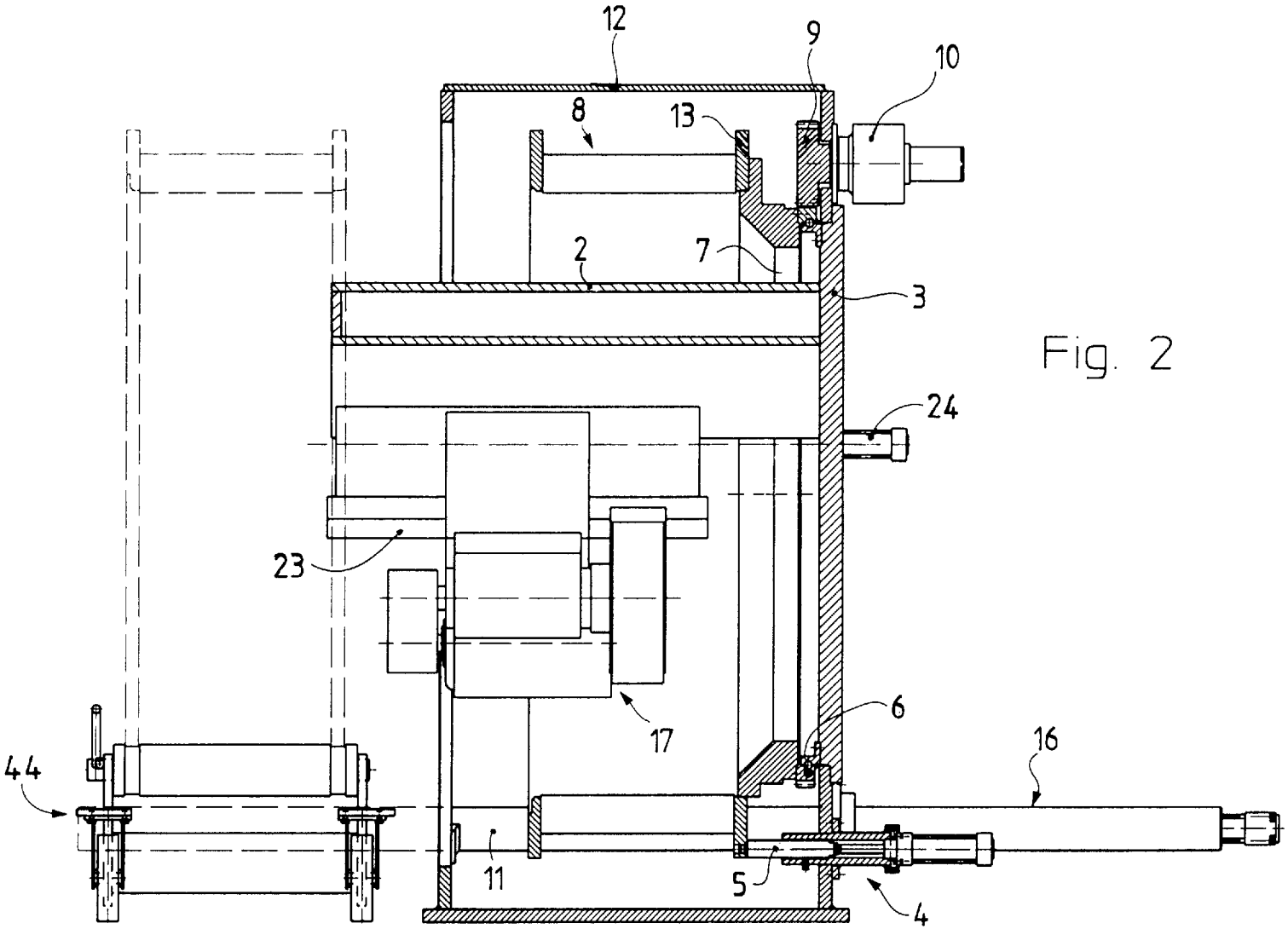
FIG. 2 a sectional view of the device of FIG. 1 taken along line II—II.
Figure 3:
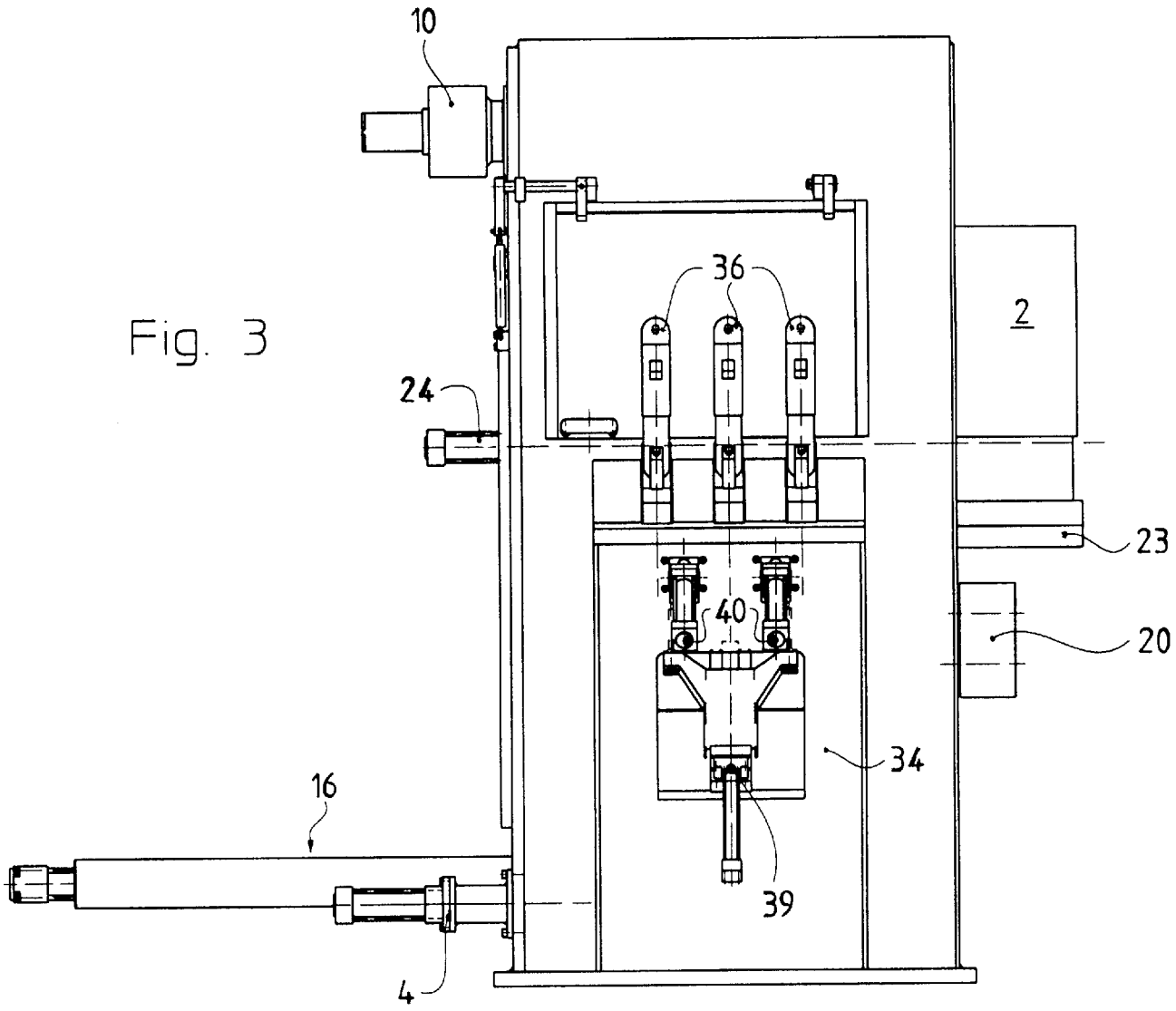
FIG. 3 a side view of the resharpening device of FIG. 1 in the direction of the arrow III.

According to FIGS. 1 and 2 the resharpening device comprises a machine frame 1 onto which an equipment table 2 is attached by means of a circular vertical supporting plate 3. On the supporting plate 3 pivots a turnring 6 which is connected with an axis vertical rotational ring 7 for the concentric attachment of a knife rim 8. The turnring 6 is put in rotation by a pinion 9 whose driving motor 10 is flanged to the rear of the machine frame 1. The machine frame 1 is surrounded by a protective housing 12 which is depicted only in FIG. 2 and FIG. 3 in order to give a clear overview of the parts essential to the invention. To the machine frame 1 a pneumatically activated stop unit 4 is attached which stop bolt 5, while the knife ring is turning by steps, will snap in one after another into positional boreholes 14 which are assigned in one of its two ring discs-13 to the individual knives carriers 15 in such a manner that they are positioned on the prolongation of a straight line connecting the center M of the knife rim 8 with the respective cutting edge S.

In the lower area of the machine frame 1, a pneumatically activated sliding carriage 16 consisting of two parallel support rods 11 is provided for installation and take-out, with which the knife rim 8 is pushed in or out of the resharpening device.

The equipment table 2 holds a grinding unit 17 comprising a grinding disc 18, a motor 19 and a belt drive 20. The grinding unit 17 is attached to a support 21 which is moveable in radial direction on an advance track 22 and in an axial direction on a slide guide 23. During the sharpening process the axial back and forth movement is provided by a hydraulic unit 24 controlled by limit switches. For the programmed radial movement of the grinding unit 17 a program controlled special drive 25 can be used. Bellow sleeves 26 are provided to protect the advance track 22.

Figure 5:
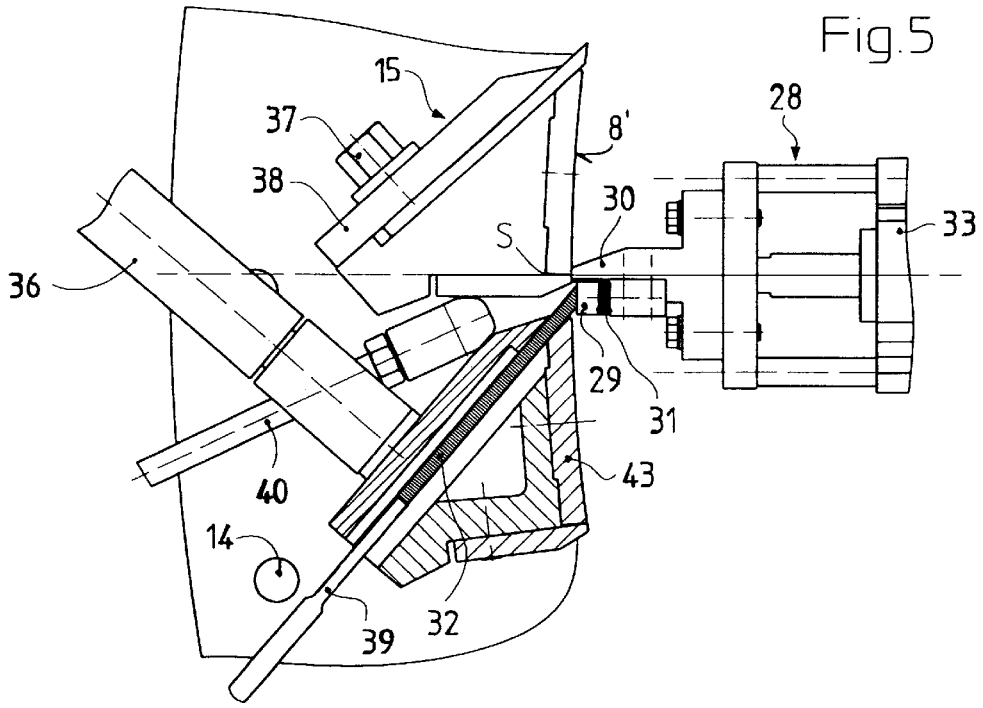
FIG. 5 a particular detail in a further enlarged scale

On the equipment table 2 there is an adjustment device 28 which comprises a pneumatically activated knife stop face 29 to which a position sensor 30 is rigidly assigned, whose purpose is to gauge the state of wear of the inner wall 8' of the knife rim 8. As shown by FIG. 5, by adding thin plates 31 at the knife stop face 29, the-uniform feed of the knives 32 can be adjusted to the respective wear of the edges. The program-controlled radial movement of the knife stop face 29 is handled by a pneumatic unit 33.

Figure 4:
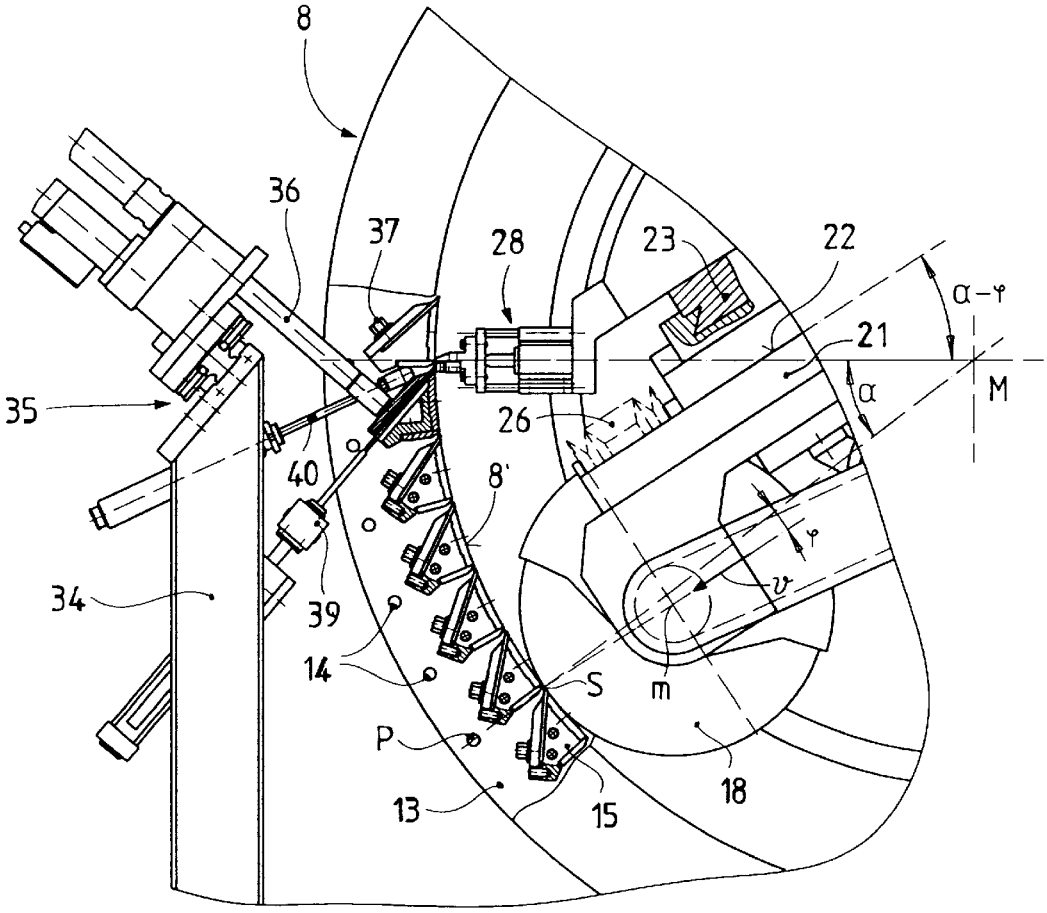
FIG. 4 details of the device of FIG. 1 on an enlarged scale
Figure 6:
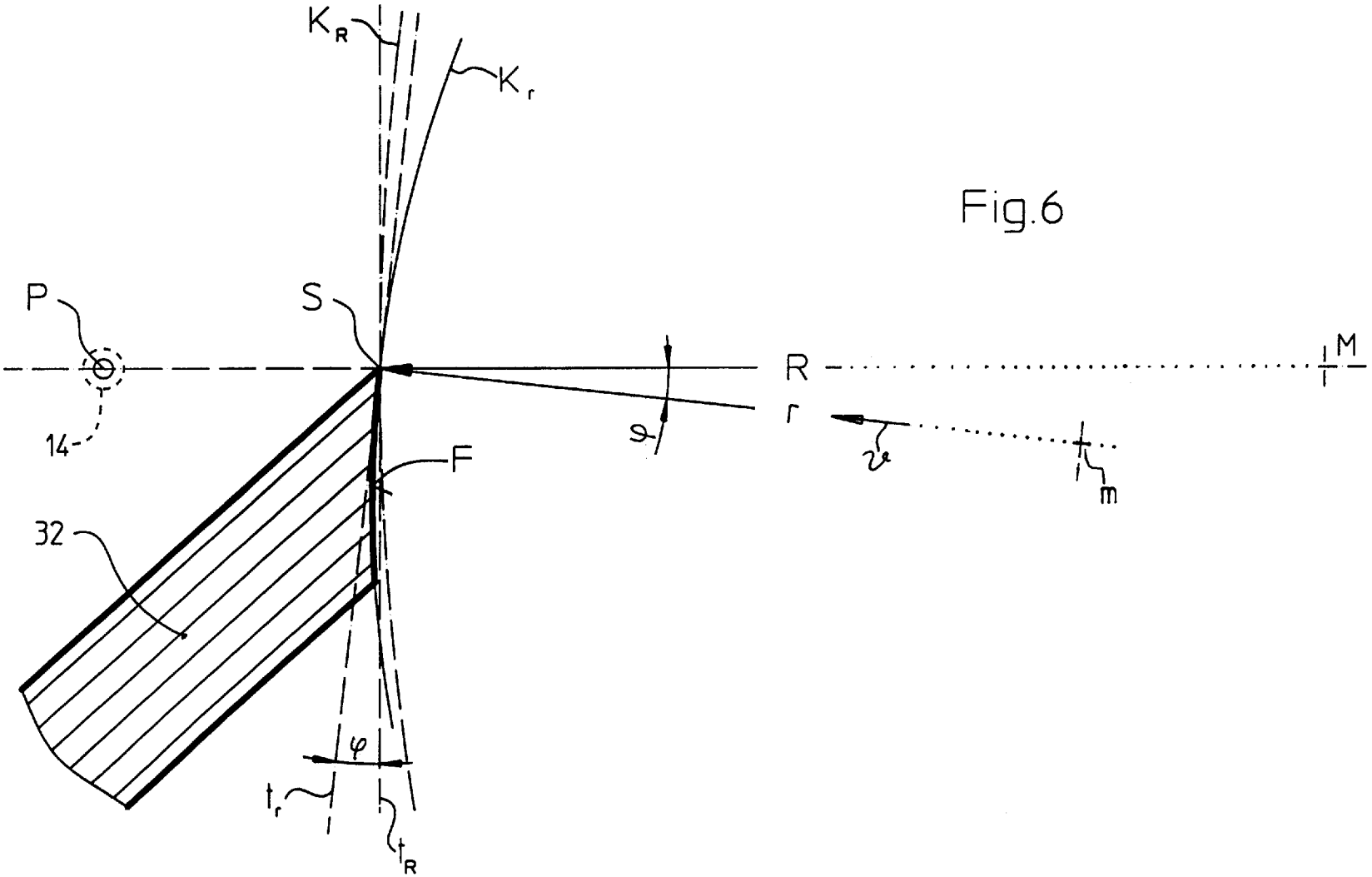
FIG. 6 the grinding geometry of the sharpening process according to the invention, shown with a very enlarged knife.

According to the invention and as shown in detail by the grinding geometry illustrated by FIG. 6, the advance track 22 of the grinding support 21 is inclined toward the radial ray R of the cutting circle $K_R$ tangential to the effective area of the grinding unit 17 by the required clearance angle $\phi$. Furthermore, as illustrated by FIG. 4, in the illustrated possible embodiment of the invention the effective area of the grinding unit 17 is staggered to the effective direction of the adjustment unit 28 by an offset angle $\alpha$ which results in the fact that the advance track 22 of the grinding support 21 is inclined to the effective direction of the adjustment unit 28 by an angle $(\alpha-\phi)$.

A tool combination 35, which is mounted on a tool rack 34 is used to advance the individual knives 32 up to the knife stop 29 as determined by the position sensor 30. The tool combination consists of a spindle 36 for loosening and tightening the clamping screws 37 at the knife carriers 15, a knives' tamping tool 39 used to individually advance the knives 32, and lastly two hold down devices 40 which take care of holding down the loosened knife holder plates 38 while the knives are advanced. All tools 36, 39 and 40 are pneumatically activated via program control. In addition, in the lower part of the tool rack 34 a compressed air nozzle 41 is located also on a sliding track 42 and is moveable back and forth in the direction of the axle via a pneumatic unit which is controlled by limit switches.

The grinding geometry illustrated in FIG. 6 by a much enlarged view of the knife 32 shows a knife edge S which stop position P is determined by the positional boreholes 14. In this position the radial ray R beginning in the center M of the cutting circle $K_R$ and the radial ray r beginning in the center m of the grinding circle $K_r$ are crossing and hereby their assigned tangents $t_R$ and $t_r$ define the clearance angle $\phi$. The grinding forward feed v is done in the direction of the radial ray r of the grinding circle $k_r$ and whereby the face F of the knives gets a concave contour consistent with the grinding circle $K_r$.

According to the invention the described resharpening device functions as follows:

After a knife rim 8 is removed from a flaker, it is transported on a special cart 44 into the sharpening room where it will be put in position in front of the resharpening device as can be seen in FIG. 2. Then the sliding carriage 16 used for installation and take-out is moved out so far that its support rods 1 reach under the knife rim 8 and put it on its reverse movement onto the centering position provided on the rotational ring 7 on which the rim gets fastened. Now the knife rim 8 first gets cleaned by back and forth movements of the compressed air nozzle 41 while the knife rim is rotating slowly. Then the stop bolt 5 of the stop unit 4 snaps into one of the positional boreholes 14 of the knife rim 8 so that the concerned knife edge S is tangent to the straight line linking the center M of the knife rim 8 and the stop position P. Thus the direction of the grinding feed v includes the clearance angle $\phi$ at the knife edge S, as shown schematically in FIG. 6.

Now the centrally controlled automatic function sequence of the sharpening process begins: at first the spindles 36 loosen the clamping screws 37 of the knives' carrier 15 one after another. At the same time the knife stop face 29 of the adjustment device 28 is radially advanced far enough by its pneumatic unit 33 that its assigned position sensor 30 sits closely to a place on the inner wall 8' of the knife rim 8 adjacent to one of the concerned knife edge S, as e.g., at the wear shoe 43. Now the hold down devices 40 and the tamping tools 39 are activated, pushing inward the concerned knife 32 of the knife rim 8 until its cutting edge S abuts against the knife stop face 29 of the adjustment device 28.

This position of the knife is then fixed by successive tightening of the clamping screws 37 by means of the spindles 36 and simultaneous pulling back of the tamping tools 39 and hold down devices 40. Next the central control causes the pulling back of the knife stop face 29 and of the stop bolt 5 out of the positional borehole 14 as well as the rotation of the knife rim 8 by one knife spacing, after which the stop bolt 5 snaps into the next positional borehole 14. Then the advancing of the knives is repeated as already explained.

When, after the knife rim 8 has been rotated several times, in the illustrated embodiment after the rim has been rotated 5 times, the knife which had been advanced first comes into the effective area of the grinding disc 18, the grinding process is started. From now on the grinding of the knife edges S occurs with the advancing of the knives at another location at the one and same locking position of the knife rim 8.

The central control system now causes the grinding support 21 to be radially advanced toward the knife rim 8 until the grinding disc 18, which has been started, touches one of the advanced knives 32. The grinding disc 18 takes up a torque which causes the power consumption of the drive motor 19 to rise significantly which in turn signals to the central control system, in the form of a control impulse, the beginning of the actual feed for grinding. The program controlled special drive 25 gradually moves the grinding unit 17 against the face F of the concerned knife 32.

This feed for grinding v which normally amounts to only a few tenth of millimeters is pre-programmed with two parameters as follows: on the one hand, the state of wear of the inner wall 8' of the knife rim 8 as determined by the position sensor 30, e.g., its wear shoes 43, and on the other hand the input of the targeted protrusion of the knives' edges S over the inner wall 8' of the knife rim 8. During said grinding feed, the grinding disc 18 is moved back and forth slowly in an axial direction. As soon as the grinding process at one knife 32 and the advance of a knife at another place of the knife rim 8 are completed, both active systems are returned to their initial position and the knife rim 8 rotates by one knife spacing. When all knives 32 have been advanced one after another, the grinding process is continued separately for the knives 32 which are not already sharpened because of the angle offset $\alpha$ of both effective areas of adjustment and grinding. Upon completion of the described grinding process the edges S of all knives 32 are again sharp and their protrusion over the inner wall 8' of the knife rim 8 is uniform and even.

We claim:

1. A method of resharpening knives of a size-reduction machine in which the knives are arranged and fastened in a cylindrical knife carrier in such a manner that during an operational process cutting edges of the knives form a cutting circle, wherein the knives are sharpened by grinding the cutting edges of the knives while the knives are in an installed state fastened in the knife carrier, the method comprising the steps of:

loosening a knife in the knife carrier;

advancing the loosened knife in the knife carrier towards a functional position by an amount relative to the wear of the cutting edge of the knife;

clamping the advanced knife onto the knife carrier;

sharpening the cutting edge of the knife by moving a grinding unit, which has a grinding circle, along a grinding feed coincident with a radial ray of the grinding circle, wherein the radial ray of the grinding circle and a radial ray of the cutting circle intersect at the cutting edge of the knife and form a clearance angle.

2. A method in accordance with claim 1, further comprising the step of locking the knife carrier at a stop position, wherein the advancing of the knife and the grinding of the cutting edge of the knife occur while the knife carrier remains at the stop position.

3. A method in accordance with claim 1, wherein the step of advancing the knife includes sensing a state of wear of an area of the knife carrier adjacent to the cutting edge of the knife and the step of sharpening the cutting edge of the knife includes using the state of wear to program the grinding feed.

4. A method according to claim 1, wherein the step of advancing the knife includes using the grinding unit as an adjustment stop for the cutting edge of the knife.

5. A method according to claim 1, further comprising the step of taking the knife carrier from the size-reduction machine and handling the knife carrier in a sharpening device.

6. A device for resharpening knifes of a size-reduction machine in which the knives are arranged and fastened in a knife rim with cutting edges of the knives directed toward an interior of the knife rim in such a manner that during an operational process the cutting edges of the knives form a cutting circle, wherein the knives are sharpened by grinding the cutting edges of the knives while the knives are in an installed state fastened in the knife rim, the device comprising:

a machine frame;

a rotational disc that carries the knife rim and that is mounted on the machine frame;

an advance track;

a grinding unit that sharpens a cutting edge of a knife; and a support that supports the grinding unit and that is movable along the advance track, wherein the advance track is inclined at a clearance angle relative to a radial ray of the cutting circle that intersects the cutting edge of the knife to be sharpened.

7. A device according to claim 6, further comprising an adjustment unit for uniform advancing of the knives over a cylindrical inner wall of the knife rim by an amount consistent with the wear of the cutting edges of the knives, wherein an effective area of the grinding unit is staggered relative to an effective direction of the adjustment unit by an offset angle and the advance track is inclined relative to the effective direction of the adjustment unit by an inclination angle equal to a difference between the offset angle and the clearance angle.

8. A device according to claim 7, wherein the inclination angle of the advance track is adjustable so that the clearance angle can be modified.

9. A device according to claim 7, wherein the grinding unit includes a grinding disc, and the support is movable along an axial slide guide by means of a hydraulic unit.

10. A device according to claim 6, further comprising a device for uniform advancing of the knives, which includes a tamping tool that acts on a back side of a knife and a stop face that limits advancing of the knife acted on by the tamping tool.

11. A device according to claim 10, wherein the stop face has a position sensor for the detection of states of wear at an inner wall of the knife rim, and further comprising an electronic control system that programs the grinding feed required for targeted protrusion of the cutting edges of the knives by considering an established average value of the states of wear.

* * * * *

UNITED STATES PATENT AND TRADEMARK OFFICE

CERTIFICATE OF CORRECTION

PATENT NO. : 5,868,602
DATED : February 9, 1999
INVENTOR(S) : PALLMANN

It is certified that error appears in the above-identified patent and that said Letters Patent is hereby corrected as shown below:

On Front Cover, at Item [73] Assignee, please insert
- -PALLMANN MASCHINENFABRICK GmbH & CO., KG - - .

Signed and Sealed this

Twenty-second Day of May, 2001

*Attest:*

Nicholas P. Godici

NICHOLAS P. GODICI

*Attesting Officer*

*Acting Director of the United States Patent and Trademark Office*